US008554108B2

(12) United States Patent
Lee et al.

(10) Patent No.: US 8,554,108 B2
(45) Date of Patent: Oct. 8, 2013

(54) IMAGE FORMING APPARATUS

(75) Inventors: Jun Ho Lee, Yongin-si (KR); Jeong Yong Ju, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 166 days.

(21) Appl. No.: 13/373,008

(22) Filed: Nov. 2, 2011

(65) Prior Publication Data

US 2012/0114398 A1 May 10, 2012

(30) Foreign Application Priority Data

Nov. 5, 2010 (KR) ..... 10-2010-0109913

(51) Int. Cl.
*G03G 21/16* (2006.01)

(52) U.S. Cl.
USPC ..... 399/111; 399/121

(58) Field of Classification Search
USPC ..... 399/111, 113, 121, 302
See application file for complete search history.

(56) References Cited

U.S. PATENT DOCUMENTS 6,996,354 B2 * 2/2006 Kimura et al. ..... 399/121
7,715,754 B2 * 5/2010 Sato et al. ..... 399/110

FOREIGN PATENT DOCUMENTS

JP 4-86779 3/1992
JP 2001-75377 3/2001

* cited by examiner

*Primary Examiner* — Hoang Ngo
(74) *Attorney, Agent, or Firm* — Staas & Halsey LLP

(57) ABSTRACT

An image forming apparatus includes a photosensitive body on which a visible image is developed by developer, an intermediate transfer belt to which developer of the photosensitive body is transferred, and a first transfer roller to transfer the developer from the photosensitive body to the intermediate transfer belt, wherein since a developing unit housing at which the photosensitive body is mounted is provided with position regulating guides to support a shaft of the first transfer roller, the intermediate transfer belt comes into contact with the photosensitive body at a uniform angle. As a result, uniform print quality may be obtained.

17 Claims, 11 Drawing Sheets

IMAGE FORMING APPARATUS

CROSS-REFERENCE TO RELATED APPLICATIONS

This application claims the benefit of Korean Patent Application No. 10-2010-0109913 filed on Nov. 5, 2010 in the Korean Intellectual Property Office, the disclosure of which is incorporated herein by reference.

BACKGROUND

1. Field

Embodiments of the present disclosure relate to an image forming apparatus equipped with a photosensitive body and a first transfer roller to transfer developer from the photosensitive body to an intermediate transfer belt.

2. Description of the Related Art

In general, image forming apparatuses are used to form an image on a printing medium. Examples of such an image forming apparatus include a printer, a copier, a facsimile device, and a combination device integrating functions thereof.

Such an image forming apparatus scans light to a surface of a charged photosensitive body through an optical exposure unit to form an electrostatic latent image on the surface of the photosensitive body, and then supplies developer to the electrostatic latent image to develop the electrostatic latent image into a visible image. The visible image developed on the photosensitive body through the developer is transferred to the printing medium through a transfer unit, and the developer on the printing medium is fixed to the printing medium through a fixing unit.

The transfer unit includes an intermediate transfer belt to which the developer of the photosensitive body is transferred, a first transfer roller to transfer the developer from the photosensitive body to the intermediate transfer belt, a second transfer roller to transfer the developer from the intermediate transfer belt to the printing medium, and a pair of rollers arranged at opposite sides within the intermediate transfer belt to rotate the intermediate transfer belt.

Transfer units are classified into direct type and indirect type transfer units. In the case of the direct type transfer unit, the first transfer roller allows the intermediate transfer belt to come into close contact with the photosensitive body so that the developer is transferred from the photosensitive body to the intermediate transfer belt. On the other hand, in the case of the indirect type transfer unit, electric current is applied to the intermediate transfer belt so as to allow a partial area thereof to be electrically charged so that the developer is transferred from the photosensitive body to the intermediate transfer belt by electrical attraction.

SUMMARY

Therefore, it is an aspect of the present disclosure to provide an image forming apparatus capable of allowing a relative position between a photosensitive body provided at a developing unit and a transfer roller, which is provided at a transfer unit to correspond to the photosensitive body, to be uniformly maintained.

Additional aspects of the disclosure will be set forth in part in the description which follows and, in part, will be apparent from the description, or may be learned by practice of the disclosure.

In accordance with one aspect of the present disclosure, an image forming apparatus includes a main body, a plurality of developing units separably installed at the main body, each of the plural developing units developing an electrostatic latent image into a visible image through developer, and a transfer unit to transfer the developer of each developing unit developed into the visible image to a printing medium, wherein each of the plural developing units includes a photosensitive body on which the electrostatic latent image is formed and a developing unit housing at which the photosensitive body is rotatably mounted, the transfer unit includes an intermediate transfer belt to which developer on the photosensitive body is transferred, first transfer rollers, each of the first transfer rollers transferring the developer from the photosensitive body to the intermediate transfer belt, a transfer unit frame at which the first transfer rollers are movably mounted, and a second transfer roller to transfer developer from the intermediate transfer belt to the printing medium, and the developing unit housing includes position regulating guides, each of the position regulating guides, when each developing unit is installed at the main body, supporting a shaft of each first transfer roller so that the intermediate transfer belt comes into contact with the photosensitive body at a uniform angle.

The transfer unit may include movable guides, each of the movable guides rotatably supporting the shaft of each first transfer roller while being movably mounted at the transfer unit frame, and each of the position regulating guides may include a position regulating groove to receive each movable guide.

The transfer unit may include an elastic member to elastically support each movable guide in an inward direction of the position regulating groove.

Each of the developing units may include rotational hooks, each of the rotational hooks being rotatably installed at each position regulating guide to be latched at each movable guide during rotation of the rotational hook, thereby allowing the movable guide to be maintained in a state received within the position regulating groove.

The transfer unit frame may be provided with a guide groove to guide rotation of each rotational hook, and each rotational hook may include a guide protrusion which moves along the guide groove to rotate the rotational hook.

Each of the rotational hooks may be elastically supported so as to rotate in one direction through a torsion spring.

Each of the first transfer rollers may come into contact with the intermediate transfer belt at an opposite surface of a portion of the intermediate transfer belt which comes into contact with the photosensitive body.

Each of the first transfer rollers may come into contact with the intermediate transfer belt at an adjacent portion spaced apart from a portion of the photosensitive body which comes into contact with the intermediate transfer belt.

The position regulating groove may be formed to have a U shape in section.

The position regulating groove may be formed to have a V shape in section.

In accordance with another aspect of the present disclosure, an image forming apparatus includes a photosensitive body on which a visible image is developed by developer, an intermediate transfer belt to which developer of the photosensitive body is transferred, a first transfer roller movably mounted to transfer the developer from the photosensitive body to the intermediate transfer belt, and a developing unit housing at which the photosensitive body is mounted and which is provided with position regulating guides, each of the position regulating guides supporting a shaft of the first transfer roller so that the intermediate transfer belt comes into contact with the photosensitive body at a uniform angle.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
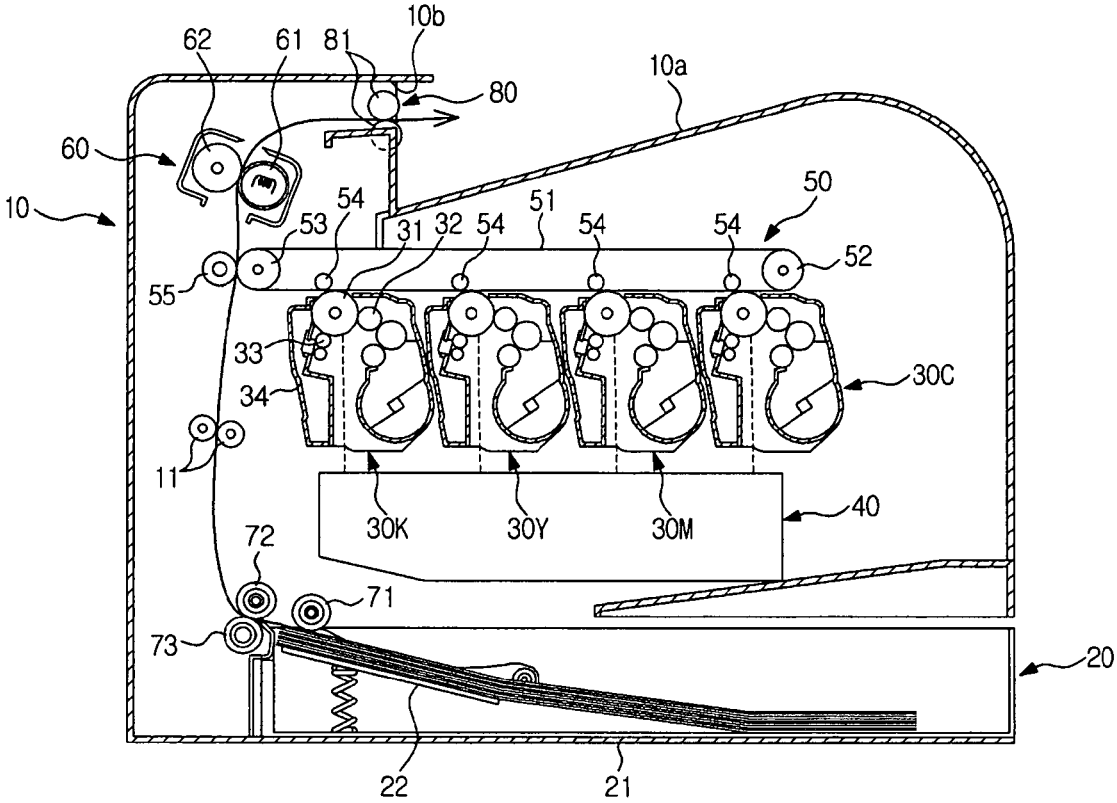
FIG. 1 is a view schematically illustrating an image forming apparatus according to an exemplary embodiment of the present disclosure.

Reference will now be made in detail to the embodiments of the present disclosure, examples of which are illustrated in the accompanying drawings, wherein like reference numerals refer to like elements throughout.

As shown in FIG. 1, an image forming apparatus according to an exemplary embodiment of the present disclosure includes a main body 10 to define an external appearance thereof, a printing medium storage unit 20 to store printing media, a plurality of developing units 30C, 30M, 30Y, and 30K to develop an electrostatic latent image into a visible image through developer, an optical exposure unit 40 to form the electrostatic latent image on a photosensitive body 31 of each charged developing unit 30C, 30M, 30Y, or 30K, a transfer unit 50 to receive each printing medium from the printing medium storage unit 20 so as to transfer the visible image formed on the photosensitive body 31 to the printing medium, and a fixing unit 60 to fix the developer transferred to the printing medium to the printing medium.

The main body 10 is provided, at an upper portion thereof, with a load portion 10*a* to load the printing medium upon which image formation has been completed, and the load portion 10*a* is provided, at one side thereof, with a delivery hole 10*b* to discharge the printing medium upon which image formation has been completed.

The printing medium storage unit 20 includes a printing medium cassette 21 mounted at the main body 10 to be able to move in front and rear directions, and a knock-up plate 22 arranged within the printing medium cassette 21 to load the printing media.

Each of the developing units 30C, 30M, 30Y, and 30K includes a photosensitive body 31 formed, on a surface thereof, with the electrostatic latent image by the optical exposure unit 40, a developing roller 32 to supply the photosensitive body 31 with the developer, a charging roller 33 to charge the surface of the photosensitive body 31, and a developing unit housing 34 to define an external appearance of the corresponding developing unit 30C, 30M, 30Y, or 30K while mounting the photosensitive body 31, the developing roller 32, and the charging roller 33.

In the exemplary embodiment, the developing unit is comprised of four developing units 30C, 30M, 30Y, and 30K which store different colors of developers, for example, cyan C, magenta M, yellow Y, and black K within the developing unit housings 34, respectively to develop the images of cyan C, magenta M, yellow Y, and black K, respectively. The four developing units 30C, 30M, 30Y, and 30K are arranged beneath the transfer unit 50 to be parallel with one another in left and right directions. Also, each developing unit 30C, 30M, 30Y, or 30K is separably installed at the main body 10 to be replaced after consumption of the developer stored in the corresponding developing unit 30C, 30M, 30Y, or 30K. Although not shown, the four developing units 30C, 30M, 30Y, and 30K as described above are separably received in a drawer (not shown) movably mounted at the main body 10 so as to be received within or withdrawn from the main body 10 along with movement of the drawer.

The optical exposure unit 40 irradiates light including image information to the photosensitive body 31 provided at each developing unit 30C, 30M, 30Y, or 30K to form the electrostatic latent image on the surface of the photosensitive body 31.

Figure 2:
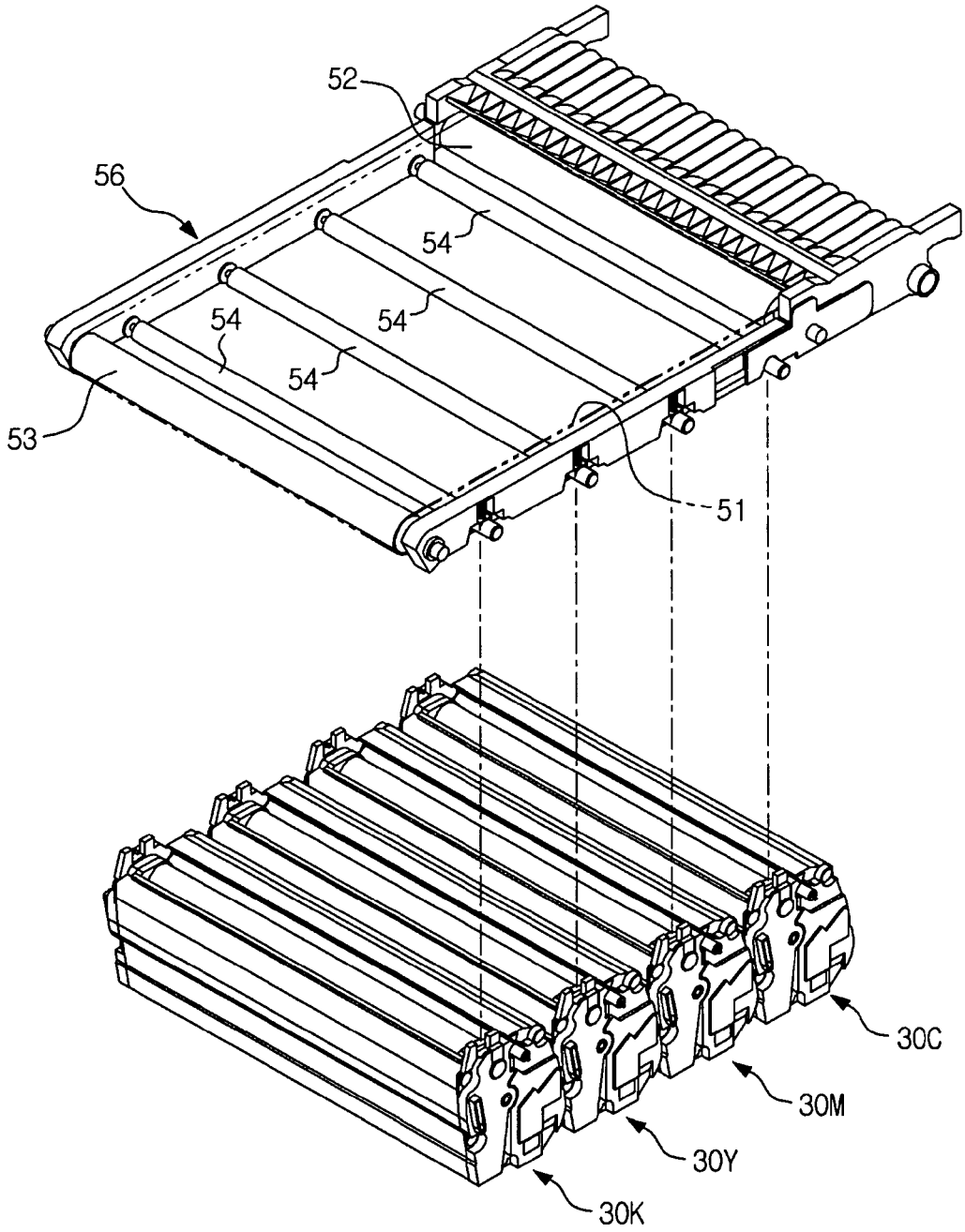
FIG. 2 is a perspective view illustrating a transfer unit and developing units applied to the image forming apparatus according to the exemplary embodiment of the present disclosure.

As shown in FIG. 2, the transfer unit 50 includes an intermediate transfer belt 51, a pair of rollers 52 and 53, first transfer rollers 54, a second transfer roller 55 (see FIG. 1), and a transfer unit frame 56. The intermediate transfer belt 51 transfers each developer developed into the visible image on the corresponding photosensitive body 31. The rollers 52 and 53 are arranged at opposite sides within the intermediate transfer belt 51 to rotate the intermediate transfer belt 51. Each of the first transfer rollers 54 is arranged to face the corresponding photosensitive body 31 of each developing unit 30C, 30M, 30Y, or 30K in a state in which the intermediate transfer belt 51 is interposed therebetween so as to transfer the visible image of the photosensitive body 31 to the intermediate transfer belt 51. The second transfer roller 55 is arranged to face a corresponding one of the two rollers 52 and 53 in a state in which the intermediate transfer belt 51 is interposed therebetween so as to transfer the visible image of the intermediate transfer belt 51 to the printing medium. Opposite ends of each roller 52 or 53 and opposite ends of each first transfer roller 54 are mounted at the transfer unit frame 56.

In the exemplary embodiment, each first transfer roller 54 comes into contact with the intermediate transfer belt 51. In detail, the first transfer roller 54 comes into contact with the intermediate transfer belt 51 at an adjacent portion spaced apart from a portion of the corresponding photosensitive body 31 which comes into contact with the intermediate transfer belt 51, as shown in FIG. 1. Furthermore, electric current is applied to the first transfer roller 54 so that electrical attraction may be generated at a partial area of the intermediate transfer belt 51 which comes into contact with the first transfer roller 54. Accordingly, this electrical attraction allows the developer to be transferred from the photosensitive body 31 to the intermediate transfer belt 51.

The pair of rollers 52 and 53 includes a drive roller 52 to rotate by supply of rotational force from a drive source of a motor (not shown), etc., and a driven roller 53 to rotate by supply of rotational force through the intermediate transfer belt 51. The driven roller 53 is arranged to face the second transfer roller 55.

The fixing unit 60 includes a heating roller 61 to generate heat, and a pressure roller 62 formed, on a peripheral surface thereof, of an elastically deformable material to press the printing medium against a peripheral surface of the heating roller 61.

In addition, the main body 10 is provided with a pick-up unit 70 arranged at an upper portion of one side of the printing medium storage unit 20 to pick up the printing media loaded on the knock-up plate 22 sheet by sheet, and a pair of feeding rollers 11 arranged above the pick-up unit 70 to guide the printing medium picked up by the pick-up unit 70 to the transfer unit 50 located above the feeding rollers 11, and a delivery unit 80 arranged above the fixing unit 60 while being arranged at a portion adjacent to the delivery hole 10*b* so that the printing medium passing through the fixing unit 60 is discharged through the delivery hole 10*b*.

The pick-up unit 70 includes a pick-up roller 71 coming into contact with the printing media on the knock-up plate 22 to pick up the printing media sheet by sheet, a forward roller 72 to move the printing medium picked up by the pick-up roller 71 toward the feeding rollers 11, and a retard roller 73 arranged to face the forward roller 72 to prevent the plural printing media from moving at the same time.

The delivery unit 80 includes a pair of delivery rollers 81 which are arranged at an inner side of the delivery hole 10*b*.

In such an image forming apparatus, the above-mentioned four developing units 30C, 30M, 30Y, and 30K are separably installed at the main body 10 to be replaced after consumption of the respective developers stored in the corresponding developing units 30C, 30M, 30Y, and 30K. As described above, when each of the developing units 30C, 30M, 30Y, and 30K is to be replaced, each photosensitive body 31 may have a fine positional difference due to manufacturing tolerance, etc., compared to the corresponding photosensitive body 31 before replacement of the developing unit 30C, 30M, 30Y, or 30K When a position of the photosensitive body 31 is varied, an angle between the photosensitive body 31 and the intermediate transfer belt 51 may be changed. Accordingly, since an amount of the developer transferred from the photosensitive body 31 to the intermediate transfer belt 51 is varied when the angle between the photosensitive body 31 and the intermediate transfer belt 51 is changed, print quality is varied every time the developing unit 30C, 30M, 30Y, or 30K is replaced. In particular, this is frequently generated in the case of an indirect type transfer unit in which the developer is transferred from the photosensitive body 31 to the intermediate transfer belt 51 by electrical attraction as shown in the exemplary embodiment.

In this case, the angle between the intermediate transfer belt 51 and the photosensitive body 31 is determined by a relative position between the photosensitive body 31 and the first transfer roller 54. Thus, when the relative position between the photosensitive body 31 and the first transfer roller 54 is uniformly maintained, uniform print quality may be obtained even when the developing units 30C, 30M, 30Y, and 30K are replaced.

Figure 3:
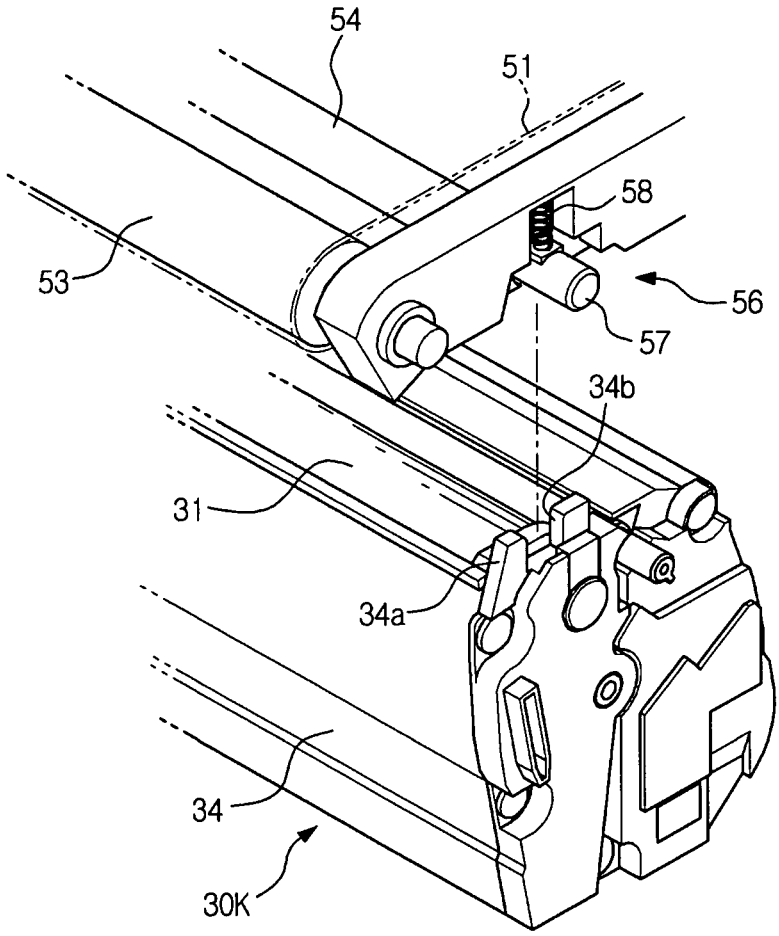
FIG. 3 is a perspective view illustrating movable guides and position regulating guides applied to the image forming apparatus according to the exemplary embodiment of the present disclosure.

In order to uniformly maintain the relative position between the photosensitive body 31 and the first transfer roller 54, each first transfer roller 54 is movably mounted at the transfer unit frame 56 within a predetermined range. Furthermore, as shown in FIG. 3, the developing unit housing 34 is protrusively formed with position regulating guides 34*a* to support a shaft 54*a* of the first transfer roller 54 when the developing unit 30K is installed at the main body 10. In this case, since each of the developing units 30C, 30M, 30Y, and 30K has an identical installation structure, the installation structure of the developing unit 30K capable of developing the black image will be described below.

Figure 4:
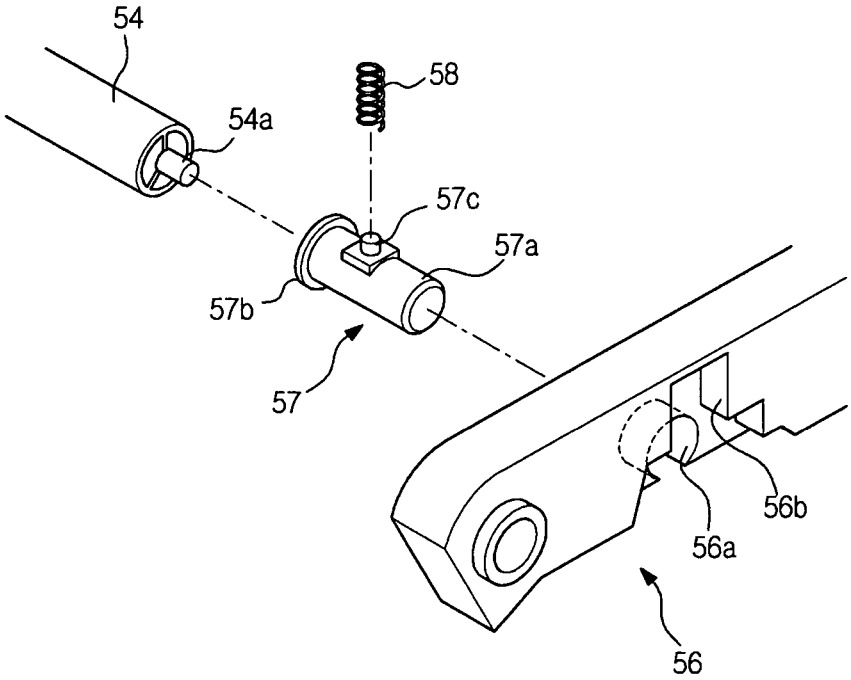
FIG. 4 is an exploded perspective view illustrating an installation structure of one movable guide applied to the image forming apparatus according to the exemplary embodiment of the present disclosure.

In the exemplary embodiment, as shown in FIG. 4, the transfer unit 50 includes movable guides 57 movably mounted at the transfer unit frame 56 while the shaft 54*a* of the first transfer roller 54 is rotatably installed at the movable guides 57. Consequently, the position regulating guides 34*a* indirectly support the shaft 54*a* of the first transfer roller 54 in the transfer unit 50 through the respective movable guides 57. In order to support each movable guide 57, the corresponding position regulating guide 34*a* is formed to have a U shape so as to be provided with a position regulating groove 34*b* to receive and support the movable guide 57. Accordingly, the movable guide 57 is supported, on opposite side ends thereof, at inner opposite side surfaces of the position regulating groove 34*b*.

In the exemplary embodiment, the transfer unit 50 includes elastic members 58 to stably maintain a state in which the movable guides 57 are respectively received and supported within the position regulating grooves 34*b*. Each elastic member 58 is supported, at one end thereof, at the movable guide 57 while being supported, at the other end thereof, at the transfer unit frame 56 so that the movable guide 57 is elastically supported at the transfer unit frame 56.

Each of the movable guides 57 includes a support portion 57*a*, a latch portion 57*b*, and a support protrusion 57*c*. The support portion 57*a* is penetrated, at a partial portion thereof, through a through hole 56*a* formed at the transfer unit frame 56 to protrude outwards, and is then received and supported within the position regulating groove 34*b*. The latch portion 57*b* is latched at a portion adjacent to the through hole 56*a* of the transfer unit frame 56 to prevent deviation of the movable guide 57 from the transfer unit frame 56. The support protrusion 57*c* extends upwards from the support portion 57*a* to be inserted into the elastic member 58 so as to stably maintain a state in which the elastic member 58 is supported, at one end thereof, at the movable guide 57.

The transfer unit frame is formed, at opposite side surfaces thereof, with the through holes 56*a* as described above, and is concavely formed with receiving grooves 56*b* to receive the respective elastic members 58 and position regulating guides 34*a*.

Figure 5:
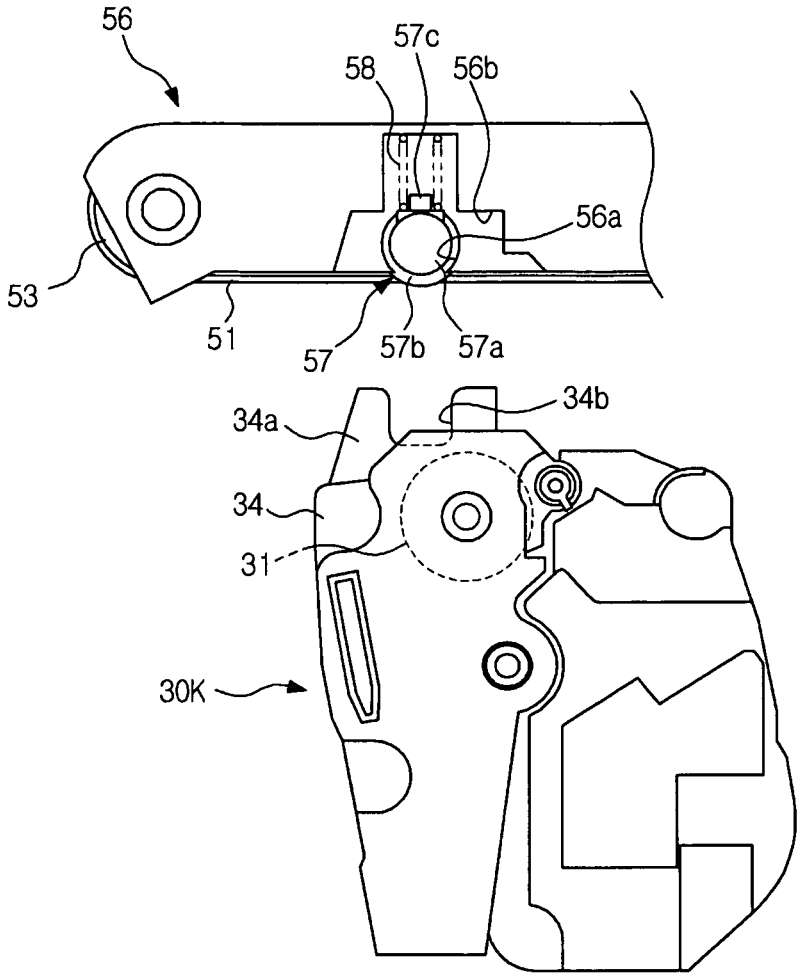
FIGS. 5 and 6 are side views illustrating operation between the movable guide and the position regulating guide applied to the image forming apparatus according to the exemplary embodiment of the present disclosure.
Figure 6:
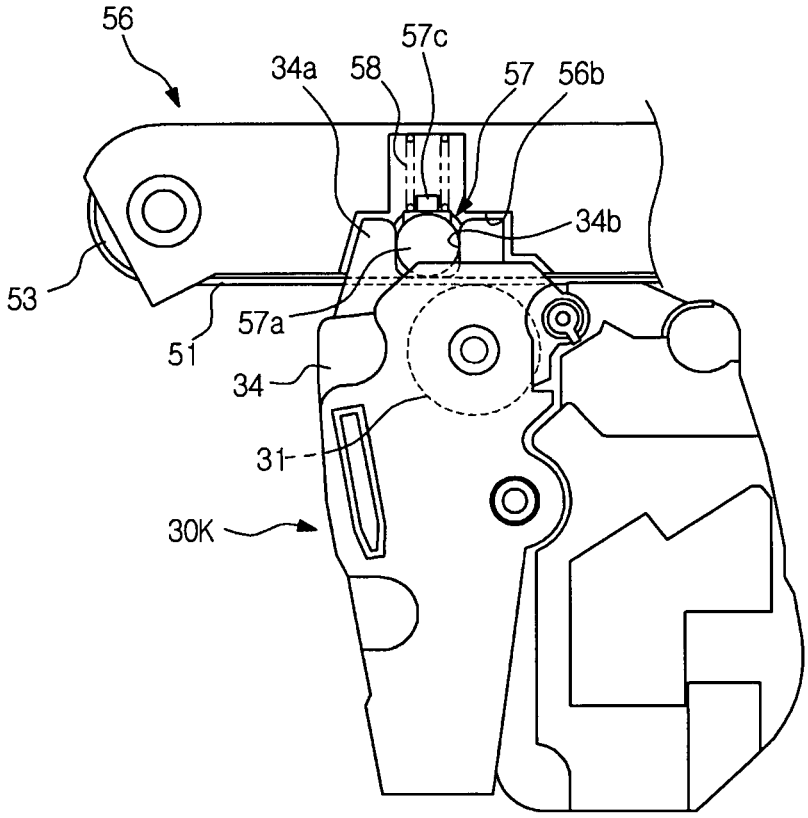

Accordingly, when the developing unit 30K is installed at the main body 10 and then moves upwards in a state arranged beneath the transfer unit 50 as shown in FIG. 5, each position regulating guide 34*a* enters the inside of the corresponding receiving groove 56*b*, and the support portion 57*a* of each movable guide 57 is received within the corresponding position regulating groove 34*b* of the position regulating guide 34*a* as shown in FIG. 6. In this case, the support portion 57*a* is supported, at opposite side ends thereof, at the opposite side surfaces of the position regulating groove 34*b* while being supported, at a lower end thereof, at a lower surface of the position regulating groove 34*b* by elastic restoration force of the elastic member 58. Accordingly, a relative position between each movable guide 57 and the photosensitive body 31 is exactly adjusted in a uniform position. As a result, the relative position between the photosensitive body 31 and the first transfer roller 54 is uniformly maintained even when the developing unit 30K is replaced. As described above, when the relative position between the photosensitive body 31 and the first transfer roller 54 is uniformly regulated, the intermediate transfer belt 51 comes into contact with the photosensitive body 31 at a uniform angle. Therefore, an amount of the developer transferred from the photosensitive body 31 to the intermediate transfer belt 51 is uniformly maintained, and thus print quality is kept uniform even when the developing unit 30K is replaced.

Figure 7:
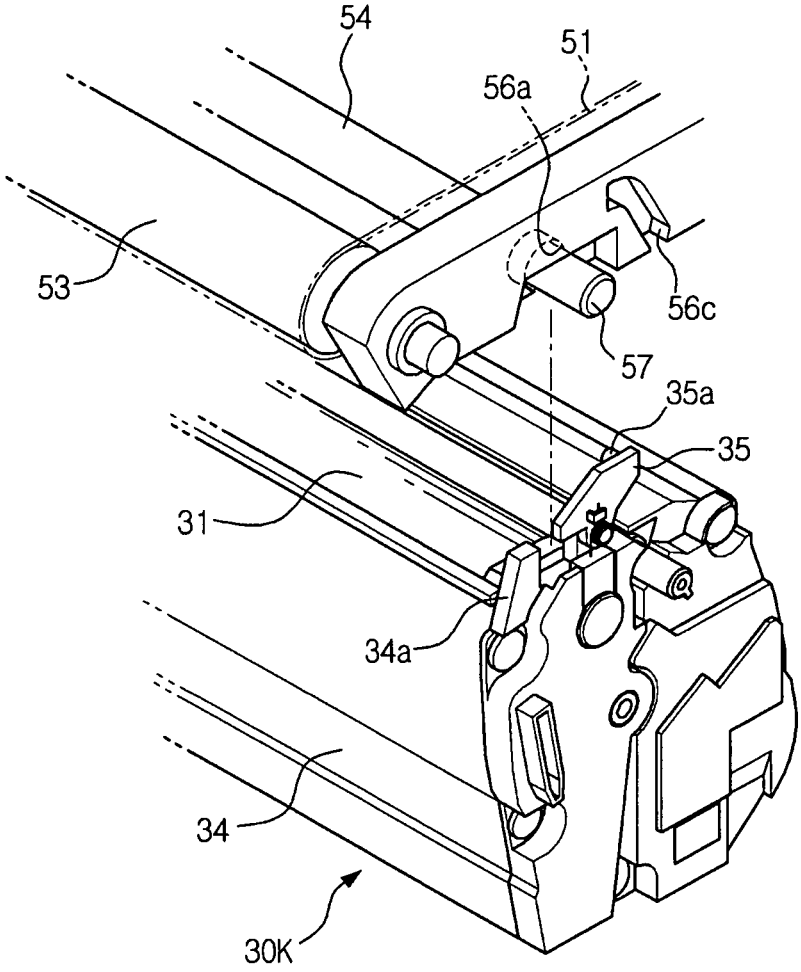
FIG. 7 is a perspective view illustrating movable guides and position regulating guides applied to an image forming apparatus according to another exemplary embodiment of the present disclosure.
Figure 8:
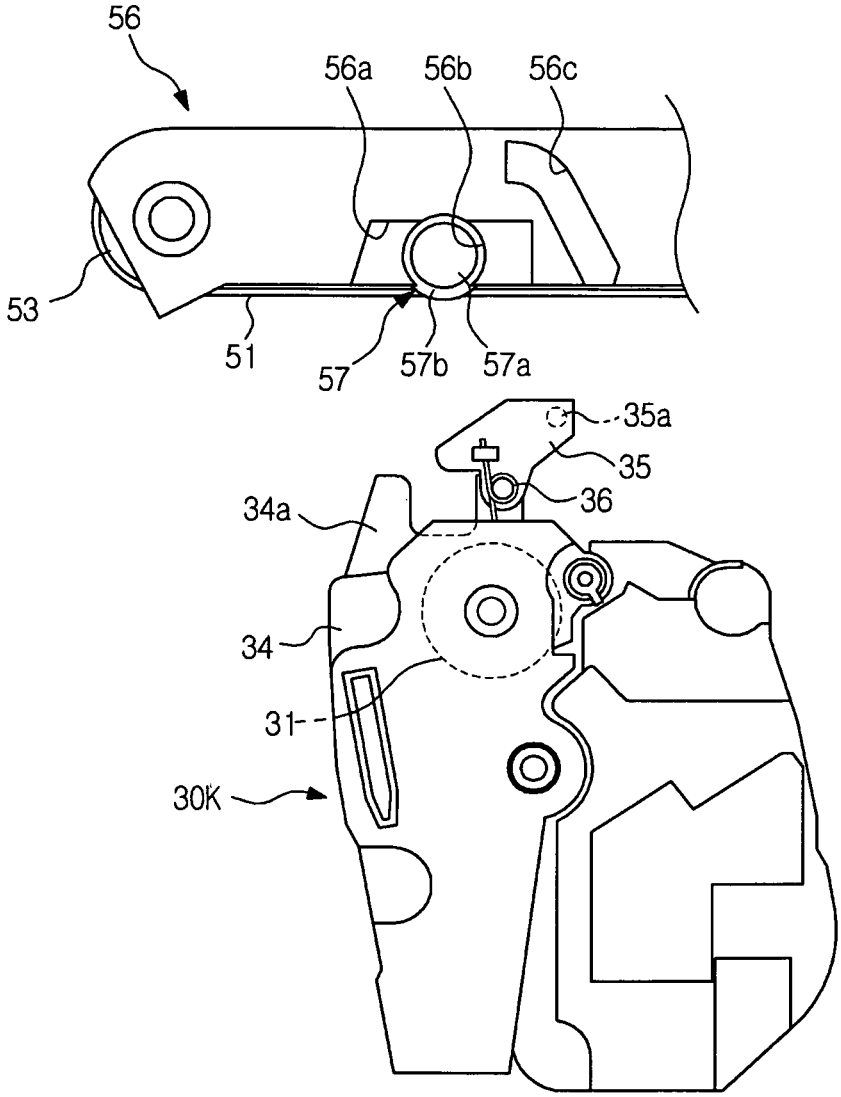
FIGS. 8 to 10 are side views illustrating operation between one movable guide and the position regulating guide applied to the image forming apparatus according to another exemplary embodiment of the present disclosure.

In the exemplary embodiment as described above, although the state in which the movable guides 57 are respectively received within the position regulating grooves 34*b* is maintained through the elastic members 58, embodiments of the present disclosure are not limited thereto. As shown in FIGS. 7 and 8 as another exemplary embodiment of the present disclosure, the state in which the movable guides 57 are respectively received and supported within the position regulating grooves 34*b* may also be maintained through rotational hooks 35.

Each of the rotational hooks 35 is rotatably installed at the corresponding position regulating guide 34*a* so as to rotate in one direction through a torsion spring 36. Such a rotational hook 35 rotates according to upward movement of the developing unit 30K to support the movable guide 57 received within the position regulating groove 34*b*.

To achieve this, the transfer unit frame 56 is formed with a guide groove 56*c* to guide rotation of each rotational hook 35, and the rotational hook 35 is protrusively formed with a guide protrusion 35*a* which moves along the guide groove 56*c*.

Figure 9:
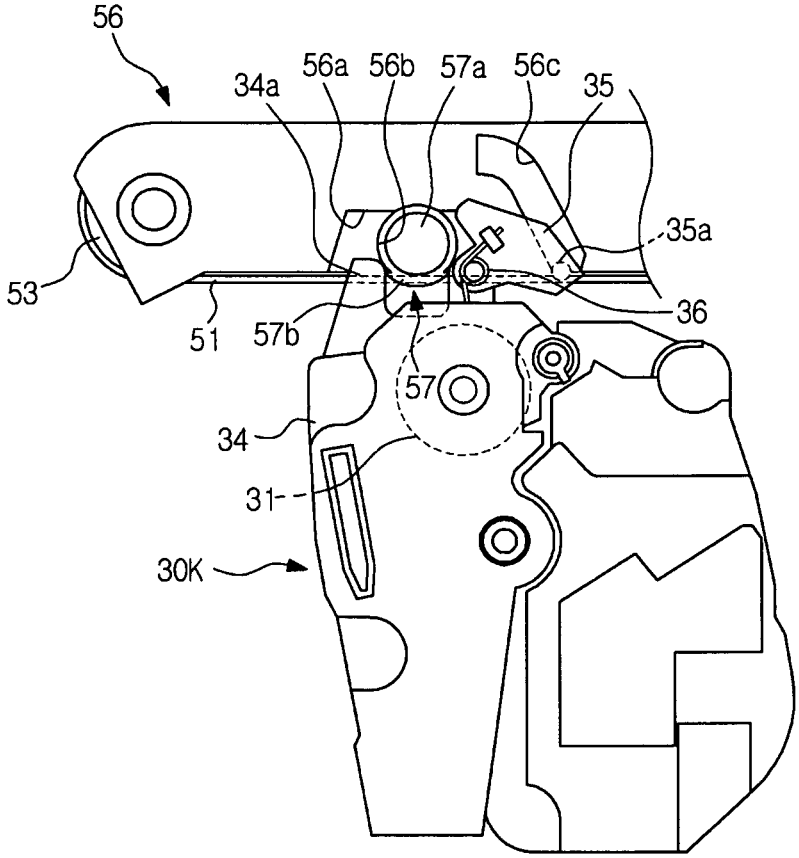
Figure 10:
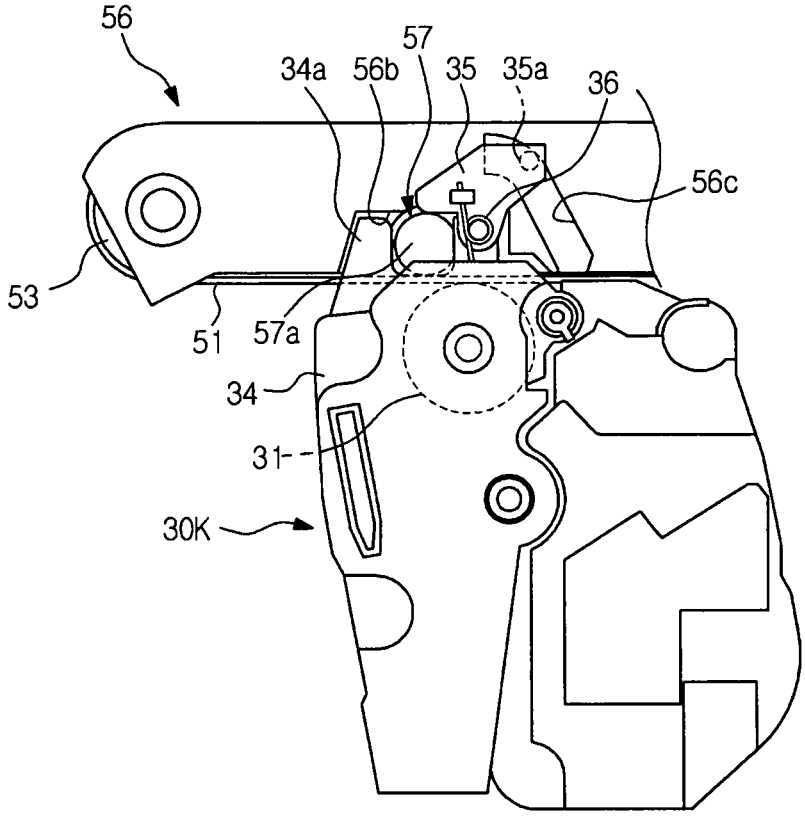

When the developing unit 30K is installed at the main body 10 and then moves upwards, each guide protrusion 35*a* is latched at a lower surface of the transfer unit frame 56, thereby rotating the corresponding rotational hook 35, as shown in FIG. 9. In the case of rotation of each rotational hook 35, when the guide protrusion 35*a* reaches a position corresponding to the guide groove 56*c*, the guide protrusion 35*a* may move along the guide groove 56*c*. Therefore, as shown in FIG. 10, the rotational hook 35 supports an upper end of the movable guide 57 while rotating by elastic restoration force of the torsion spring 36. In this state, the support portion 57*a* of the movable guide 57 is supported, on the opposite side ends and lower end thereof, at the opposite side surfaces and lower surface of the position regulating groove 34*b*, respectively, whereas the upper end of the support portion 57*a* is supported by the rotational hook 35. Consequently, the state in which the movable guide 57 is received and supported within the position regulating groove 34*b* is maintained.

Figure 11:
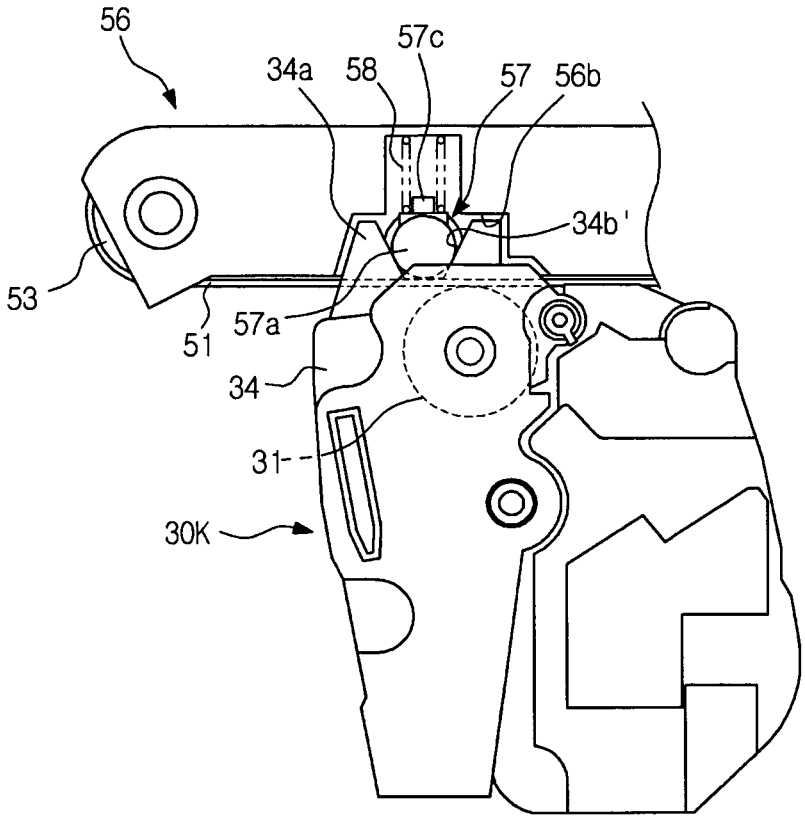
FIG. 11 is a side view illustrating movable guides and position regulating guides applied to an image forming apparatus according to another exemplary embodiment of the present disclosure.

In the exemplary embodiments as described above, although each position regulating groove 34*b* is formed to have the U shape in section, but embodiments of the present disclosure are not limited thereto. As shown in FIG. 11, the position regulating groove 34*b*' may be formed to have a V shape in section.

Since the position regulating groove 34*b* which has the U shape in section supports symmetrical portions of left and right opposite sides of the movable guide 57, movement in left and right directions of the movable guide 57 may be effectively restricted. On the other hand, since the position regulating groove 34*b*' which has the V shape in section is formed as a slope surface, the movable guide 57 may be easily guided into the position regulating groove 34*b*' in the case of installation of the developing unit 39K.

Accordingly, the position regulating groove 34*b* having the U shape and the position regulating groove 34*b*' having the V shape may be selectively used according a kind of the image forming apparatus to which the present disclosure is applied.

As is apparent from the above description, when the developing unit is installed at the main body, the shaft of the first transfer roller is supported by the position regulating guides provided at the developing unit housing. Therefore, since the relative position between the first transfer roller and the photosensitive body is regulated, the intermediate transfer belt comes into contact with the photosensitive body at a uniform angle. As a result, uniform print quality may be obtained.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a main body;

a plurality of developing units separably installed at the main body, each of the plural developing units developing an electrostatic latent image into a visible image through developer; and a transfer unit to transfer the developer of each developing unit developed into the visible image to a printing medium, wherein each of the plural developing units comprises a photosensitive body on which the electrostatic latent image is formed, and a developing unit housing at which the photosensitive body is rotatably mounted;

the transfer unit comprises an intermediate transfer belt to which developer on the photosensitive body is transferred, first transfer rollers, each of the first transfer rollers transferring the developer from the photosensitive body to the intermediate transfer belt, a transfer unit frame at which the first transfer rollers are movably mounted, and a second transfer roller to transfer developer from the intermediate transfer belt to the printing medium; and the developing unit housing comprises position regulating guides, each of the position regulating guides, when each developing unit is installed at the main body, supporting a shaft of each first transfer roller so that the intermediate transfer belt comes into contact with the photosensitive body at a uniform angle.

2. The image forming apparatus according to claim 1, wherein:

the transfer unit comprises movable guides, each of the movable guides rotatably supporting the shaft of each first transfer roller while being movably mounted at the transfer unit frame; and each of the position regulating guides comprises a position regulating groove to receive each movable guide.

3. The image forming apparatus according to claim 2, wherein the transfer unit comprises an elastic member to elastically support each movable guide in an inward direction of the position regulating groove.

4. The image forming apparatus according to claim 2, wherein each of the developing units comprises rotational hooks, each of the rotational hooks being rotatably installed at each position regulating guide to be latched at each movable guide during rotation of the rotational hook, thereby allowing the movable guide to be maintained in a state received within the position regulating groove.

5. The image forming apparatus according to claim 4, wherein:

the transfer unit frame is provided with a guide groove to guide rotation of each rotational hook; and each rotational hook comprises a guide protrusion which moves along the guide groove to rotate the rotational hook.

6. The image forming apparatus according to claim 4, wherein each of the rotational hooks is elastically supported so as to rotate in one direction through a torsion spring.

7. The image forming apparatus according to claim 1, wherein each of the first transfer rollers comes into contact with the intermediate transfer belt at an adjacent portion spaced apart from a portion of the photosensitive body which comes into contact with the intermediate transfer belt.

8. The image forming apparatus according to claim 2, wherein the position regulating groove is formed to have a U shape in section.

9. The image forming apparatus according to claim 2, wherein the position regulating groove is formed to have a V shape in section.

10. An image forming apparatus comprising:

a photosensitive body on which a visible image is developed by developer;

an intermediate transfer belt to which developer of the photosensitive body is transferred;

a first transfer roller movably mounted to transfer the developer from the photosensitive body to the intermediate transfer belt; and a developing unit housing at which the photosensitive body is mounted and which is provided with position regulating guides, each of the position regulating guides supporting a shaft of the first transfer roller so that the intermediate transfer belt comes into contact with the photosensitive body at a uniform angle.

11. The image forming apparatus according to claim 10, further comprising:

movable guides movably mounted so that the shaft of the first transfer roller is rotatably installed at the movable guides, wherein each of the position regulating guides comprises a position regulating groove to receive each movable guide.

12. The image forming apparatus according to claim 11, further comprising:

an elastic member to elastically support each movable guide in an inward direction of the position regulating groove.

13. The image forming apparatus according to claim 11, further comprising:

a rotational hook rotatably installed at each position regulating guide to be latched at each movable guide during rotation of the rotational hook, thereby allowing the movable guide to be maintained in a state received within the position regulating groove.

14. The image forming apparatus according to claim 13, wherein the rotational hook is elastically supported so as to rotate in one direction through a torsion spring.

15. The image forming apparatus according to claim 11, wherein the position regulating groove is formed to have a U shape in section.

16. The image forming apparatus according to claim 11, wherein the position regulating groove is formed to have a V shape in section.

17. The image forming apparatus according to claim 11, wherein each of the movable guides includes a support portion, a latch portion and a support protrusion.

* * * * *